United States Patent [19]

Labate

[11] Patent Number: 5,004,495

[45] Date of Patent: Apr. 2, 1991

[54] METHOD FOR PRODUCING ULTRA CLEAN STEEL

[76] Inventor: Micheal D. Labate, 115 Hazen Ave., Ellwood City, Pa.

[21] Appl. No.: 475,341

[22] Filed: Feb. 5, 1990

[51] Int. Cl.[5] ..... C21B 3/04; C21B 7/072

[52] U.S. Cl. ..... 75/10.22; 75/528; 75/548; 75/552; 75/582; 75/584

[58] Field of Search ..... 75/10.22, 548, 528, 75/552, 582, 584; 266/217, 227; 164/473, 475; 222/593, 603

[56] References Cited

U.S. PATENT DOCUMENTS

| | | | |
|---|---|---|---|
| 3,814,167 | 6/1974 | Listhuber et al. | 266/229 |
| 4,179,103 | 12/1979 | Bentz et al. . | |
| 4,337,115 | 7/1982 | Daussan et al. . | |
| 4,368,834 | 1/1983 | Daussan et al. | 222/593 |
| 4,372,544 | 2/1983 | LaBate . | |
| 4,508,571 | 4/1985 | Nakato et al. | 164/473 |
| 4,619,443 | 10/1986 | Mitchell | 266/229 |
| 4,624,292 | 11/1986 | Labate | 164/475 |
| 4,645,534 | 2/1987 | D'Angelo et al. | 75/10.22 |
| 4,667,939 | 5/1987 | Luyckx | 75/407 |
| 4,695,042 | 9/1987 | Kudou . | |
| 4,740,241 | 4/1988 | LaBate . | |
| 4,781,122 | 11/1988 | Foulard et al. | 266/207 |

*Primary Examiner*—Melvyn J. Andrews
*Attorney, Agent, or Firm*—Harpman & Harpman

[57] ABSTRACT

A method and apparatus for the forced production of exceptionally clean steel wherein a metallurgical vessel is insulated and sealed to maintain a neutral environment into which steel is tapped and cleaned by use of gas injection and impurity precipitation and removal.

12 Claims, 3 Drawing Sheets

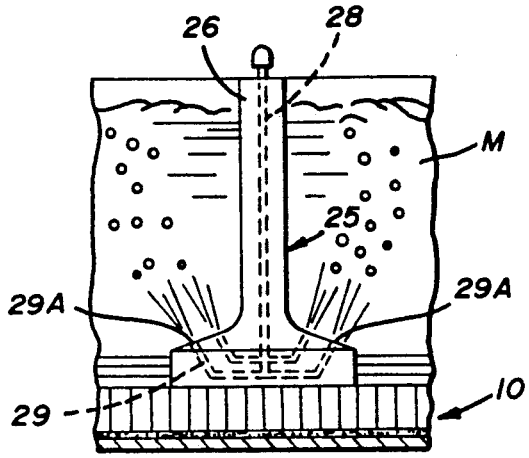
FIG. 5
FIG. 4
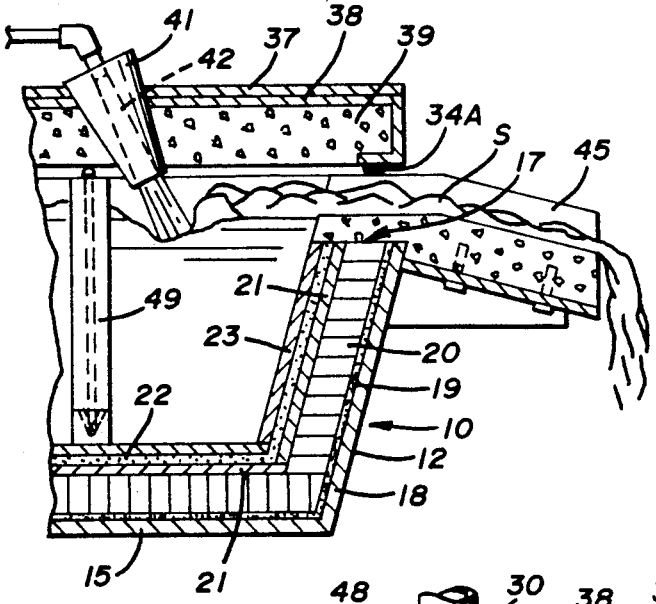
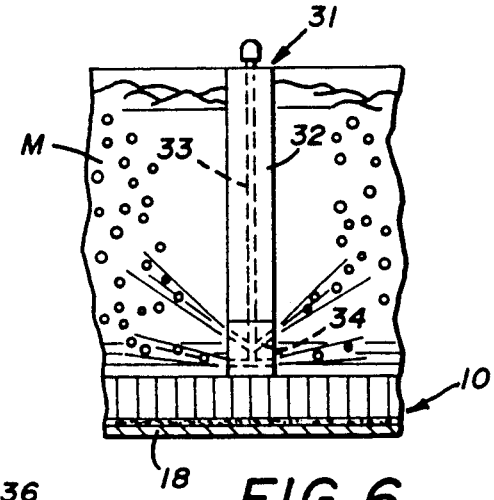
FIG. 6
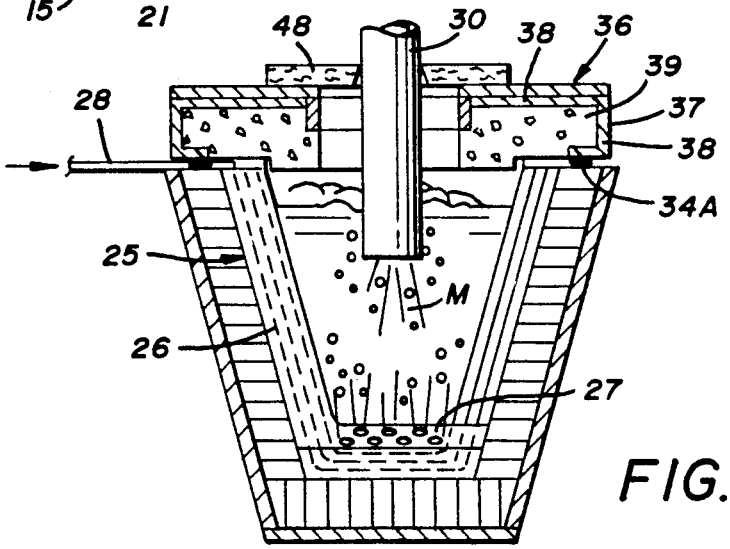
FIG. 7

METHOD FOR PRODUCING ULTRA CLEAN STEEL

BACKGROUND OF THE INVENTION

1. Technical Field

This invention relates to a method and apparatus for the production of clean steel for continuous casters and the like.

2. Description of Prior Art

Prior Art methods and apparatus have for the most part been directed towards the addition of agents and the use of gas stirring within the ladle to keep nonmetallics from being included when the steel is tapped from the ladle. Additional devices have been developed to float on the steel as it is being tapped from the ladle or closed by darts to seal the tap hole at a predetermined point just prior to excessive inclusion of nonmetallics, see for example U.S. Pat. Nos. 4,695,042, 4,179,103, 4,740,241 and 4,339,115.

A few devices have been used to address this problem in a tundish which is an intermediate metallurgical pouring vessel.

In large tundishes nonmetallic material is often forced down from the top of the tundish by the pressure of new molten metal entering the tundish. Such material thus intrained within the tundish accumulates in dead spaces and does not normally circulate sufficiently. This problem is further compounded by the loss of temperature within the tundish by heat transfer through the exterior walls and barriers therein called weirs in the top of the tundish which restrict liquid flow continuously across the surface of the metal bath for the desired flow pattern and the removal of floating nonmetallics.

Such devices referred to as dams and gas injectors, see for example U.S. Pat. Nos. 4,619,443 and 4,372,544.

In applicant's U.S. Pat. No. 4,740,241 a lance for ladles is disclosed using a refractory shape with a plurality of tubular openings therein to direct and discharge gas into the ladle under pressure.

U.S. Pat. No. 4,695,042 is directed towards a lance supporting apparatus for lifting, lowering and rotating the lance for positioning within the molten steel.

U.S. Pat. No. 4,179,103 discloses a gas delivering tube within a refractory that is inserted into a metallurgical vessel.

U.S. Pat. No. 4,619,443 discloses a gas distribution tundish barrier partially within the wall and floor of the tundish.

U.S. Pat. No. 4,372,544 a blast furnace trough and linear combination is disclosed in which a monolithic precast liner is formed for placement inside of a tundish with the liner formed of multiple layers of coalesced material under different densities to achieve an increased wear factor and insulation.

U.S. Pat. No. 4,339,115 discloses a heat insulating lining having refractory brick lining embedded and covered with a semi-compressable layers of mineral or inorganic fiber base temperature resistant material with a layer of plate material.

SUMMARY OF THE INVENTION

A method and apparatus for producing clean steel from a tundish by the elimination of all available nonmetallic inclusions by floating and drawing off of the nonmetallic material using a combination of devices to effectively stir and direct the molten bath releasing the non-metallics entrained therein forcing them to the surface to be drawn off the top as the clean steel is tapped from the bottom of the tundish.

DESCRIPTION OF THE DRAWINGS

FIG. 4 is a partial cross-sectional view of a covered tundish with an insulated notch and slag runner;

FIG. 5 is a partial cross-sectional view of the tundish with a combined impact pad and stirring unit;

FIG. 6 is a partial cross-sectional plan view of the tundish with a combined stirring lance and dam; and FIG. 7 is a cross-sectional view of the tundish with a stream shroud and combined stirring lance and impact pad therein.

DESCRIPTION OF THE PREFERRED EMBODIMENT

Figure 1:
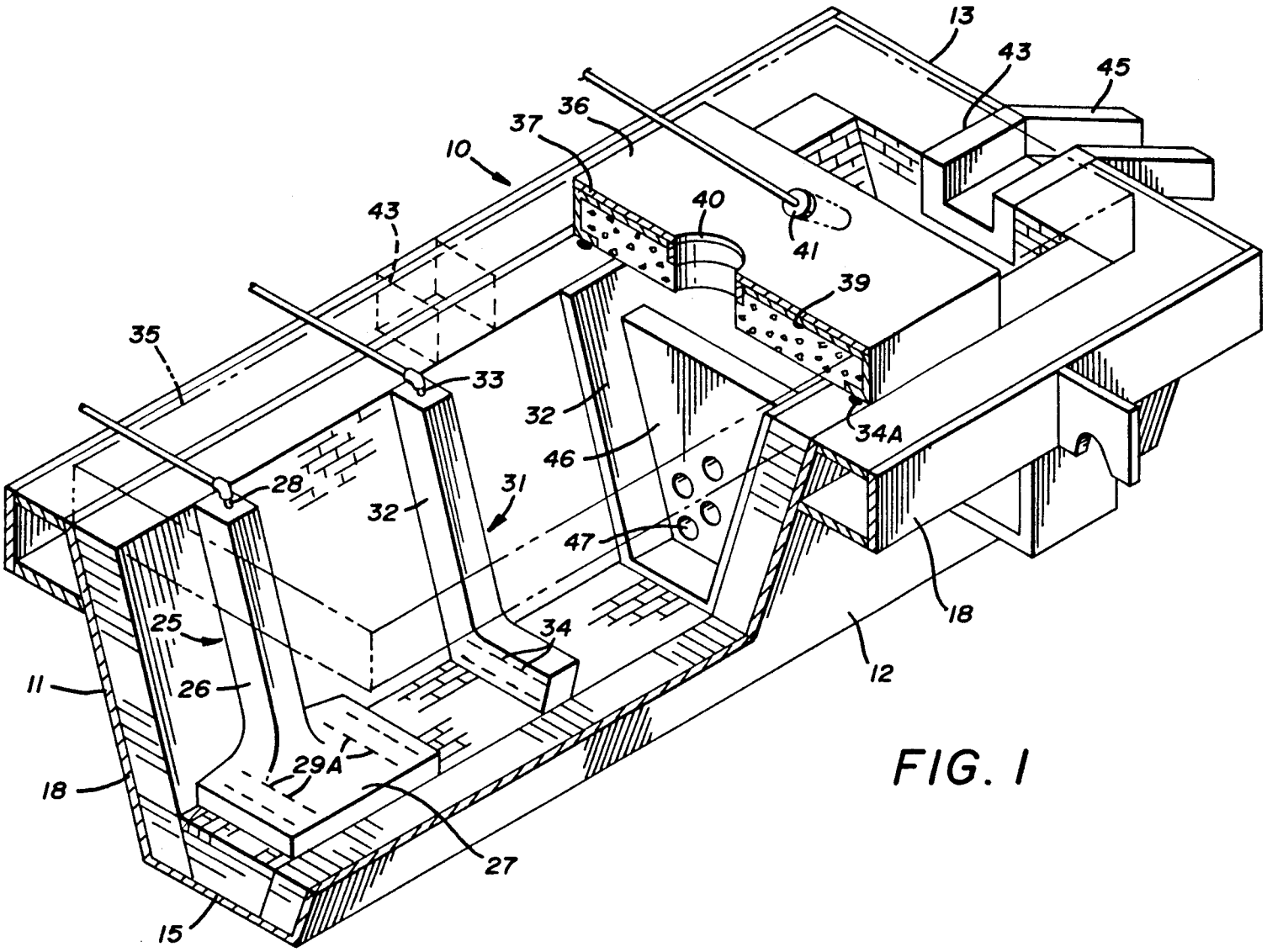
FIG. 1 is a perspective view of a modified tundish with the combination of cleaning apparatus positioned within.
Figure 3:
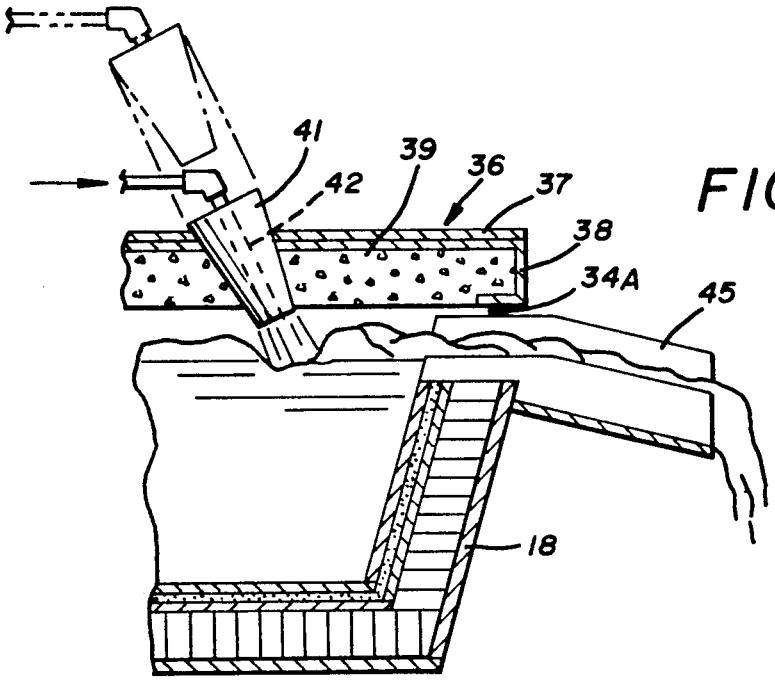
FIG. 3 is a partial cross-sectional view of the tundish and a directional stirring gas unit in the insulated cover thereof.
Figure 2:
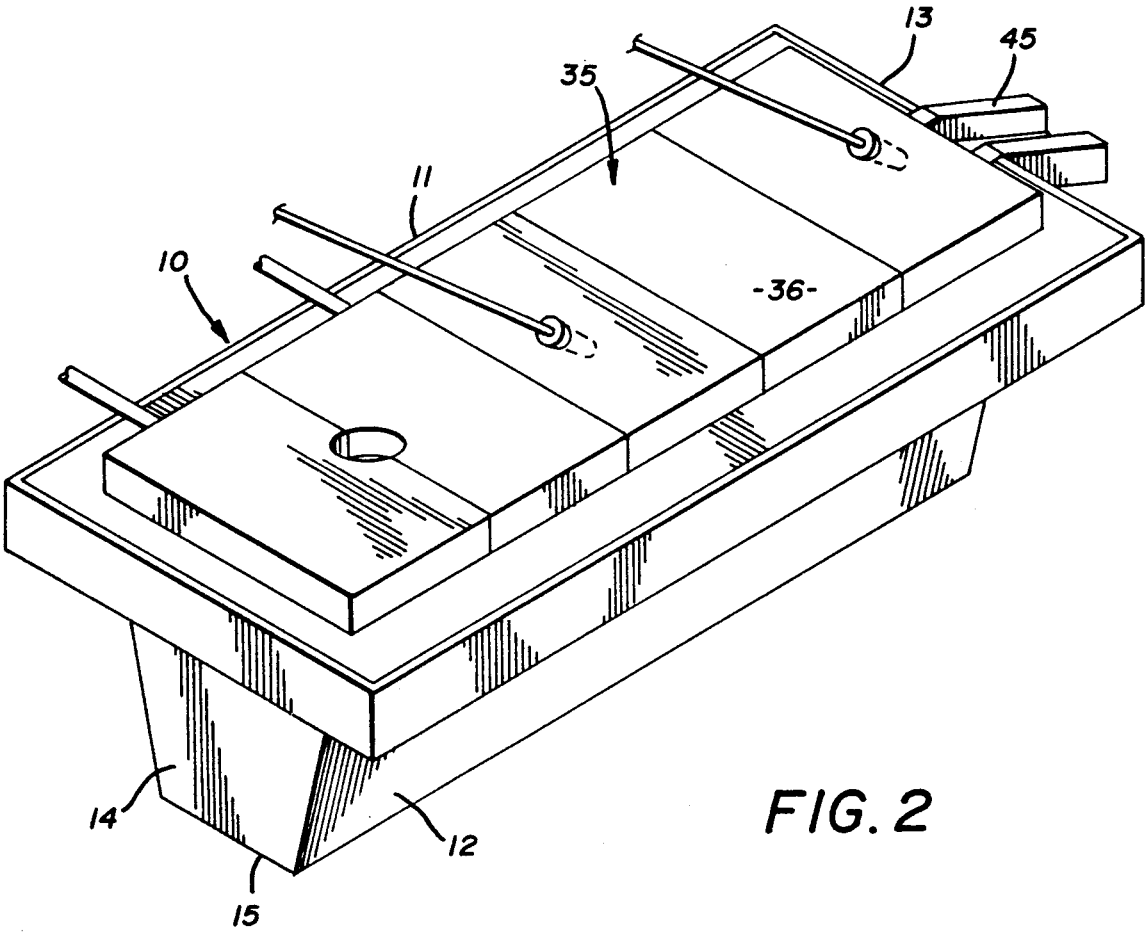
FIG. 2 is a perspective view of the covered tundish of the invention.

Referring now to FIGS. 1 and 2 of the drawings a tundish 10 can be seen having front and back walls 11 and 12, end walls 13 and 14 and an integral bottom 15. A typical tundish is a metal vessel having a steel shell 18 lined with refractory.

In this method an insulating layer numeral 17 is used that may be placed in front of any existing refractory or directly against the steel shell 18 as in this example.

The insulating layer 17 is composed of a multiple layered configuration beginning with a graphite coating 19, an insulation refractory brick 20, an insulation board 21 and an insulation powder 22. A consumable layer is composed of a magnesite insulating board 23 which is positioned over the insulating layer 17 as will be described. This insulating layer prevents the rapid heat transfer associated with molten metal to the metal shell 18 and to outside atmosphere. The insulating layer maintains the molten steel within the tundish 10 at a higher temperature which is needed to implement the multiple steps of the cleaning process.

In this example the tundish shell 18 is coated with the graphite coating mixture suspended in an aqueous carrier. The insulating refractory brick 20 is of a ceramic wool composition based on a low density high K factor material such as fiberfrack manufactured by the Carborunbum Company of Buffalo, N.Y. The insulation board 21 can be comprised of a low thermal conductivity refractory material composed of inorganic fiberous material and particulate material with an organic binder. The fiberous material can be from a group comprised of asbestos, calcium silicate fiber, aluminosilicate fiber, alumina fiber, silica fiber, fiberglass and nylon fiber. The particulate material can be from a group consisting of silica, alumina, zircon olivine, aluminosilicates, silicon carbide, chrome and carbonaceous materials such as disclosed in applicant's U.S. Pat. No. 4,538,670. The insulation powder 22 can be any one of several noninvasive materials such as vermiculite or granulated limestone. Referring now to the magnesite board 23, the composition is similar to the insulation board 21 with the selection and inclusion of magnesia within the particular material.

Referring now to FIGS. 1, 5, and 7 of the drawings, an impact pad and gas stirring unit 25 can be seen positioned within the tundish 10 comprising a generally L-shaped cast refractory body 26 with an impact pad 27 formed on one end thereof. A supply tube 28 extends down the length of the body member 26 and within the impact pad 27. Pairs of right angularly disposed tubular branches 29 extend through the impact pad 27 and communicate with the supply tube 28 providing multiple angularly dispersed gas openings 29A in the upper surface of the impact pad 27. In FIG. 5 of the drawings the impact pad and stirring unit is shown in use aligned within an inflow stream of molten metal M through a common stream shroud 30 well known and understood by those skilled in the art. It will be apparent that the impact pad 27 will provide a resistant surface to diminish the wear on the tundish insulation layer 17 and that argon gas or the like fed under pressure through and out of ceramic tubing 28 and 29 within will form an argon bubble field with its associated turbulence to force the insoluble nonmetallics within the molten stream outwardly and upwardly around the stram shroud's point of engagement with the molten bath.

Referring now to FIGS. 1 and 6 of the drawings a gas stirring lance and dam 31 can be seen embedded within the insulation layer 17 of the tundish 10. The stirring lance and dam 31 comprises a generally L-shaped cast refractory body 32 with a gas supply tube 33 embedded within having pairs of angularly multiplely disposed gas outlet ports at 34.

Referring now to FIGS. 1, 2, and 7 of the drawings, a multiple segmented tundish cover 35 can be seen formed of individual rectangular segments 36. Each of the segments 36 is comprised of a steel shell 37 with a layer of super insulation board 38 and a precast or rammed refractory 39 within. The tundish cover 35 is in spaced relation to the molten metal bath within the tundish 10.

The segments 36 are placed in side by side abutting relation on the tundish 10 to enclose same. The tundish cover 35 is sealed in relation to the tundish by an elongated clay rope seal **34*a* positioned around the top of the tundish 10 as a seat prior to the cover segments 36 being positioned thereon which compresses and spreads the clay rope seal the numeral 34*a*** to affect a tight seal therebetween.

Some of the tundish cover segments 36 are arcuately notched at 40 on one side so that in facing pairs an annular opening is formed between respective pairs for insertion of a common stream shroud 30 for the pouring of molten metal into the tundish. Additional openings are formed within the segments 36 to receive directional stirring nozzle plugs 41 which are similar to applicant's patented devices in U.S. Pat. No. 4,632,367. In this application the stirring nozzle plugs 41 are of a metered core type having tubing 42 within to form a high velocity outlet stream of argon gas that impinges the surface of the molten bath to force and direct the floating nonmetallic insolubles towards a slag flush notch 43 within the upper edge of the tundish 10.

It will be evident to those skilled in the art that by repositioning of the directional stirring nozzle plugs 41 their angular inclination will provide for selective directional control of the insoluble nonmetallics to an alternate secondary slag flush notch 43 positioned as indicated in broken lines at 44 in FIG. 1 of the drawings.

Precast refractory slag runners 45 are positioned within the slag flush notches 43 and extend outwardly at an inclined angle from the tundish 10 to direct the slag away therefrom.

The precast refractory slag runners 45 are similar in composition and configuration to those shown in applicant's U.S. Pat. No. 4,526,351. The slag runners 45 are comprises of precast sections formed of sinter alumina powder in the range of 20% to 60% by weight, silicon carbide powder in the range of 25% to 45% by weight and fine clay or comparable powdered refractory in a range from 10% to 45% by weight together with a binder such as phosphoric acid or the like in the range from 10% to 20% by weight that chemically reacts with the powdered ingredients to form a dense heat resistant slag runner unit in this example.

An insulated weir 46 can be seen positioned in this preferred embodiment between the stirring lance dam 31 and the precast refractory slag runners 45. The insulated weir 46 is characterized by its insulating composition that diminishes heat transfer and associated heat loss. The weir 46 acts to direct the upwelling flow of the entrained insoluble nonmetallics to the surface of the molten bath and over the weir 46 while clean molten metal passes through openings in the weir at 47 to a tundish tapping nozzle (not shown) in the integral bottom 15 as well understood by those skilled in the art.

In order to enhance the removal of insoluble nonmetallics a virgin expanding tundish compound comprised of expanded graphite in this example is added to the molten bath at an accelerated rate, melting and absorbing any and all insolubles coming up from the turbulence field generated by the primary and secondary gas stirring units. The resultant increase in volume of newly formed slag and its absorption rate is tied directly to the volume of expanding tundish compound added and its inherent saturation rate before it is removed as hereinbefore described.

To help maintain the molten bath temperature at an optimum level required for flow characteristics to keep the insoluble nonmetallics precipitating and moving upwardly the addition of pure oxygen and/or argon plasma to the molten bath is required by the injection of same via independent lances generally indicated at 49 in FIG. 4 of the drawings.

With this injection of pure oxygen, for example, it is still possible to maintain a neutral atmosphere within the tundish due to the high volume of inert argon gas supplied by both the stirring lances 25 and 31 and the directional stirring nozzle plugs 41 as described above.

In operation the method for producing clean and ultra clean steel from a tundish or the like comprises the steps of insulating the tundish 10 by lining the interior with a insulation layer 17 and a final consumable layer of consumeable magnesite insulating board 23. Inserting gas stirring lance and dam 31 and impact pad and stirring unit 25 within the tundish 10 for the formation of a bubble field within the molten bath at the point of stream impact from the common stream shroud 30.

Positioning cast refractory slag runners 45 within the slag flush notches 43 for the evacuation of the insoluble nonmetallics from the molten bath and tundish.

The tundish 10 is then covered with a plurality of tundish cover segments 36 by removably sealing them to the top of the tundish to create an enclosed environment that can be purged with inert gas through the stirring nozzle plugs 41 within the cover segments 36. Alternate purging of the tundish 10 can be accomplished by the use of a consumable purging compound such as hexamethylene placed within the tundish that will react with the infusion of molten metal M to create a heavy gas forcing the ambient atmosphere within the tundish out.

The molten metal M is poured into the tundish via a common stream shroud 30 through the preformed openings in adjacent cover segments 36 aligned in this example.

A shroud seal ring 48 encloses the shroud 30 overlapping the cover segments 36 to effect a seal therebetween. The shroud 30 is positioned over the impact pad and gas stirring unit 25. The resulting bubble field created by the impact pad gas stirring unit 25 within the molten bath circulates the insolubles non-metallics to the surface. The stirring nozzle plugs 41 direct the floating nonmetallics across the surface of the molten bath to the precast slag runners 45 as hereinbefore described.

It will be evident to those skilled in the art that different combinations of the elements and steps disclosed herein can be selectively applicable depending on the degree, common nature and requirement of clean and ultra clean steel used for continuous casters and scaled down applications for pouring of ingot molds still used within the art.

Although but one embodiment of the present invention has been described in the forgoing specification, it will be apparent to those skilled in the art that various modifications may be made therein without departing from the spirit of the invention and having thus described my invention, what I claim is:

1. A process of treating molten steel to remove inoluble nonmetallic inclusions to produce clean and ultra clean steel comprising the steps of pouring molten steel into an insulated tundish having an insulated cover, maintaining a neutral atmosphere in said covered insulated tundish, stirring the molten steel with inert gas within said insulated covered tundish so as to precipitate said insoluble nonmetallic inclusions and moving same to the surface of the molten steel, maintaining and increasing molten steel temperature in said covered tundish, directing the insoluble nonmetallic inclusions from the tundish, pouring clean and ultra clean steel from the insulated tundish.

2. The process of treating molten steel of claim 1 wherein said insulated tundish has an insulated liner, said insulated liner comprising a multiple composite insulation layer and a consumable layer.

3. The process of treating molten steel of claim 1 wherein maintaining said neutral atmosphere in the covered insulated tundish comprises purging the covered tundish with inert gases through two or more directional stirring nozzles in said covered tundish.

4. The process of treating molten steel of claim 1 wherein stirring the molten steel with inert gases comprises directing said gases through primary and secondary gas stirring units within the insulated tundish.

5. The process of treating molten steel of claim 1 wherein the step of precipitating insoluble nonmetallic inclusions comprises introducing an tundish compound formed of a group consisting of expandable graphite, expandable purlite, expandable clay, in said molten steel.

6. The process of treating molten steel of claim 1 wherein the step of directing insoluble nonmetallic inclusions from said insulated tundish comprises directing inert gas through directional stirring units spaced above said molten steel.

7. The process of treating molten steel of claim 2 wherein said multiple composite insulation layer comprises in an adjacent abutting relationship a graphite coating on said tundish, insulation refractory brick, insulating board, and insulating powder.

8. The process of treating molten steel of claim 2 wherein said consumable insulation layer comprises a consumable magnesite insulation board consisting of inorganic fiberous material and particulate material, said fiberous material from a group consisting of calcium silicate fiber, aluminosilicate fiber, alumina fiber, silica fiber, fiberglass and nylon fiber, said particulate material from a group consisting of silica, alumina, zircon, olivine, aluminosilicates, silicon carbide, chrome, carbonaceous materials and magnesite.

9. The process of treating molten steel of claim 4 wherein said primary gas stirring units comprise an L-shaped cast refractory body with an enlarged impact pad on one end thereof, gas supply tubes within said body, said impact pad having multiple apertured gas outlets therein in communication with said gas supply tubes in said body.

10. The process of treating molten steel of claim 6 wherein said step of directing insoluble nonmetallic inclusions includes separating the molten steel and the insoluble nonmetallic inclusions by an apertured insulated weir positioned across said tundish.

11. The process of treating molten steel of claim 1 wherein forcing insoluble nonmetallic inclusions to the surface of the molten steel comprises the injection of pure oxygen by a lance to maintain and increase molten steel temperature within said insulated tundish.

12. The process of treating molten steel of claim 1 wherein maintaining and increasing molten steel temperature in said covered tundish comprises the injection of argon plasma via an independent lance.

* * * * *